US010429013B1

(12) United States Patent
Fang

(10) Patent No.: US 10,429,013 B1
(45) Date of Patent: Oct. 1, 2019

(54) PORTABLE WORKLIGHT

(71) Applicant: Ningbo Utec Electric Co. Ltd., Yuyao, Zhejiang (CN)

(72) Inventor: Yi Fang, Zhejiang (CN)

(73) Assignee: Ningbo Utec Electric Co. Ltd., Yuyao (CN)

( * ) Notice: Subject to any disclaimer, the term of this patent is extended or adjusted under 35 U.S.C. 154(b) by 0 days.

(21) Appl. No.: 15/972,134

(22) Filed: May 5, 2018

(51) Int. Cl.

| | |
|---|---|
| ***F21S 4/00*** | (2016.01) |
| ***F21V 21/00*** | (2006.01) |
| ***F21L 2/00*** | (2006.01) |
| ***F21V 21/30*** | (2006.01) |
| ***F21V 21/14*** | (2006.01) |
| *F21Y 115/10* | (2016.01) |

(52) U.S. Cl.
CPC ..... *F21L 2/00* (2013.01); *F21V 21/145* (2013.01); *F21V 21/30* (2013.01); *F21Y 2115/10* (2016.08)

(58) Field of Classification Search
CPC ..... F21L 2/00; F21V 21/145; F21V 21/30
See application file for complete search history.

(56) References Cited

U.S. PATENT DOCUMENTS

| | | | | |
|---|---|---|---|---|
| 7,240,883 | B2 * | 7/2007 | Liao | F21L 4/00 248/278.1 |
| D623,336 | S * | 9/2010 | Levine | D26/60 |
| 9,205,774 | B2 * | 12/2015 | Kennemer | F21L 14/00 |
| 9,366,419 | B2 * | 6/2016 | Osborn | F21V 21/0885 |
| D797,340 | S * | 9/2017 | Cai | D26/65 |
| 10,001,252 | B2 * | 6/2018 | Inskeep | H02J 7/0052 |
| 2013/0265780 | A1 * | 10/2013 | Choksi | F21V 21/145 362/373 |
| 2013/0271993 | A1 * | 10/2013 | Jan | F21V 21/30 362/249.09 |
| 2016/0215966 | A1 * | 7/2016 | Heller | A45D 44/04 |
| 2016/0298831 | A1 * | 10/2016 | Fang | F21V 21/06 |
| 2018/0163957 | A1 * | 6/2018 | Zhou | F21V 21/06 |

* cited by examiner

*Primary Examiner* — Anh T Mai
*Assistant Examiner* — Arman B Fallahkhair
(74) *Attorney, Agent, or Firm* — Raymond Sun

(57) ABSTRACT

A portable worklight has a main body having a lower end, a left side, a right side, a front surface and a rear surface, with a first illumination device provided on the front surface. The worklight also has a left side body hingedly coupled to the left side and having a second illumination device, and a right side body hingedly coupled to the right side and having a third illumination device. A base is pivotably mounted to the lower end of the main body. The worklight can be configured in a deployed position and a storage position.

8 Claims, 9 Drawing Sheets

PORTABLE WORKLIGHT

BACKGROUND OF THE INVENTION

1. Field of the Invention

The present invention relates to a lighting apparatus, and in particular, to a portable worklight that can be used to illuminate a relatively large area, and which can be collapsed into a smaller configuration for simple storage and transportation.

2. Description of the Related Art

There is a wide variety of lighting apparatus that are available to accommodate the many lighting needs inside homes, offices and large meeting areas or buildings. There are also lighting apparatus that are adapted for outdoor use. Some of the lighting apparatus are fixed in that they are secured to permanent locations (e.g., wall or ceiling lights), while others are portable in that they can be moved from one location to another location.

Many of the existing portable lighting apparatus suffer from several drawbacks. First, many of them are large and bulky, and cannot be conveniently moved from one location to another location. Second, the illumination that is delivered by the light bulbs, lamps or LEDs on these portable apparatus is often directed at a fixed direction or orientation, so that the illumination cannot be adjusted unless the location or orientation of the lighting apparatus is adjusted.

In addition, smaller portable worklights have also become important to both professionals and individuals as these worklights are useful for illuminating dark or crowded spaces. In such a setting, it is especially important for a small worklight to be able to be positioned inside a crowded space, and also illuminate a large area, and to provide the user with the ability to adjust the directions of the illumination.

Thus, there remains a need for a portable lighting apparatus that can deliver illumination to a large space in a manner where the illumination can be adjusted without moving the lighting apparatus, and which can also be conveniently packed for storage and moved around.

SUMMARY OF THE INVENTION

It is an object of the present invention is to provide a portable worklight which can deliver illumination to a crowded space.

It is another object of the present invention is to provide a portable worklight where the direction and orientation of the illumination can be conveniently adjusted.

It is a further object of the present invention is to provide a portable worklight which can be conveniently packed for convenient storage or transportation.

To accomplish these objectives, the present invention provides a portable worklight that has a main body having a lower end, a left side, a right side, a front surface and a rear surface, with a first illumination device provided on the front surface. The worklight also has a left side body hingedly coupled to the left side and having a second illumination device, and a right side body hingedly coupled to the right side and having a third illumination device, A base is pivotably mounted to the lower end of the main body. The worklight can be configured in a deployed position and a storage position. In the storage position, the left side body and the right side body are folded against the rear surface of the main body, and the rear surface of the main body is pivoted against the base. In the deployed position, the left side body and the right body are pivoted away from the rear surface of the main body.

DESCRIPTION OF THE PREFERRED EMBODIMENTS

The following detailed description is of the best presently contemplated modes of carrying out the invention. This description is not to be taken in a limiting sense, but is made merely for the purpose of illustrating general principles of embodiments of the invention. The scope of the invention is best defined by the appended claims.

The present invention provides a portable worklight 20 which is small and compact when folded and collapsed for storage, yet can be unfolded to be deployed in a manner where it can illuminate a large space. In addition, the worklight 20 has three different illumination devices 22, 24 and 26 that can be adjusted so that the orientation and direction of the illumination can be adjusted without the need to move the worklight 20.

Figure 1:
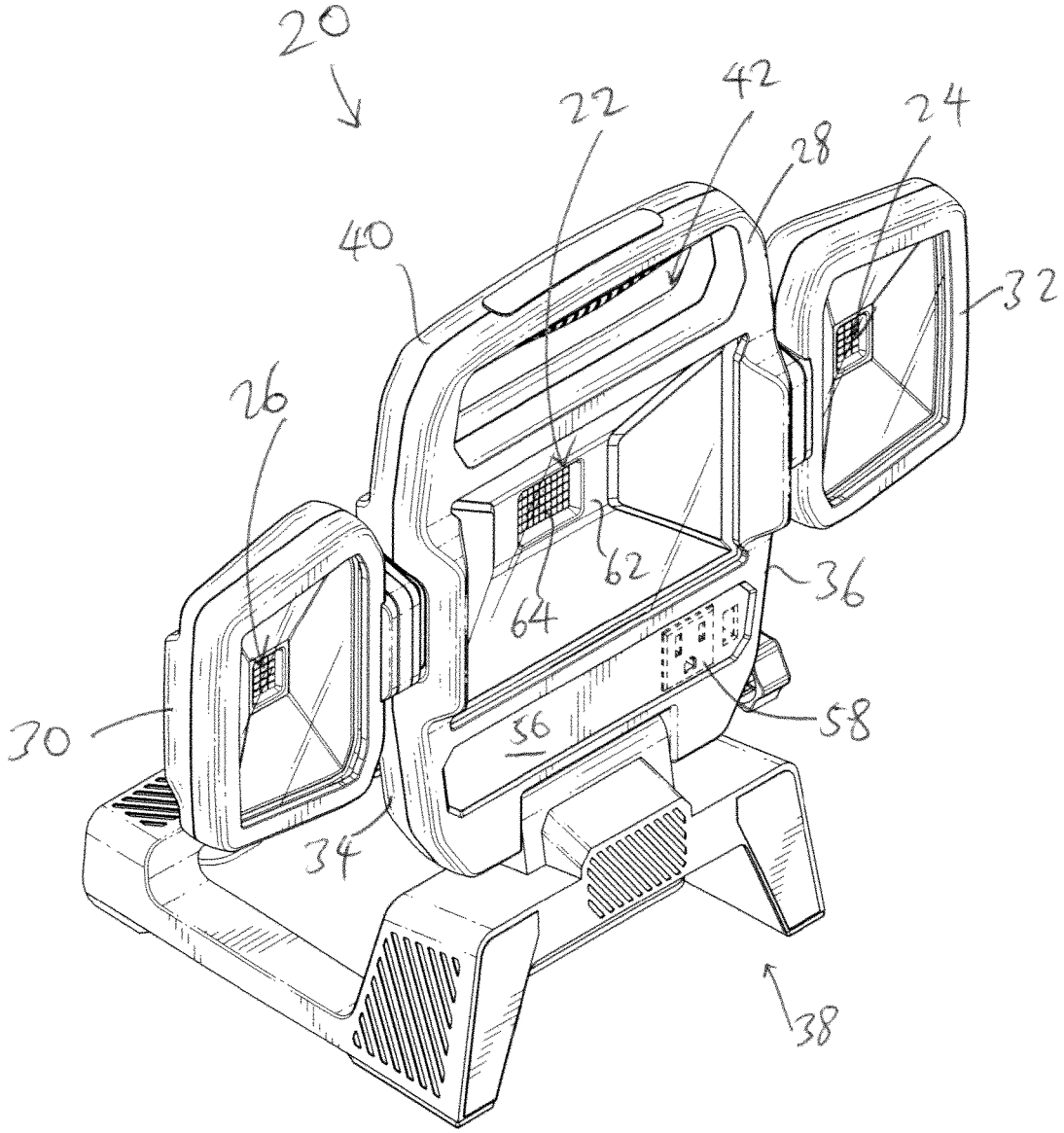
FIG. 1 is a front perspective view of a portable worklight according to the present invention shown in the deployed position.
Figure 2:
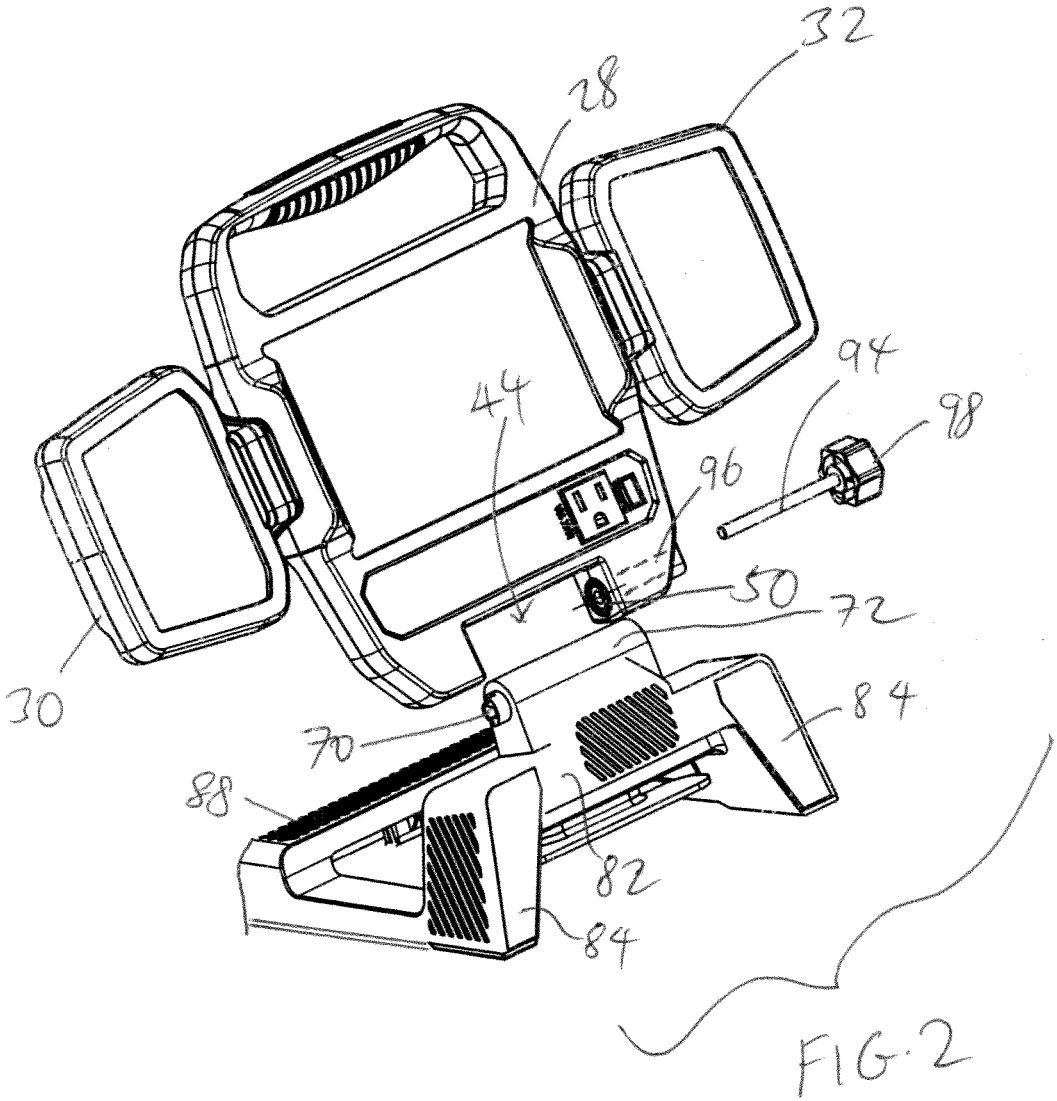
FIG. 2 is an exploded front perspective view of the worklight of FIG. 1 shown in the deployed position, and without the illumination devices.

FIGS. 1 and 2 illustrate the worklight 20 in a deployed position during normal use with its various illumination devices opened out. The worklight 20 has a main body 28, with a left side body 30 and a right side body 32 hingedly coupled to the left side 34 and the right side 36, respectively, of the main body 28. A base 38 is pivotably mounted to the lower end of the main body 28. The base 38 is described in greater detail in connection with FIGS. 6-8 and 10, and functions to provide a mounting base for the main body 28.

The main body 28 has a first illumination device 22 provided in the center of front surface of the main body 28. A handle bar 40 extends from the upper end of the main body 28, with an opening 42 defined by the handle bar 40 and the upper end of the main body 28 to allow a user's fingers to extend therethrough. A control panel 56 is provided on the front surface of the main body 28 below the illumination device 22, although it can also be provided above the illumination device 22. An electrical socket 58 can be provided along the panel 56 for coupling to a power cord (not shown), and a USB plug 104 can also be provided on the panel 56 for providing power. Switches (not shown) can also be provided on the panel 56 for controlling the operation of the worklight.

Figure 3:
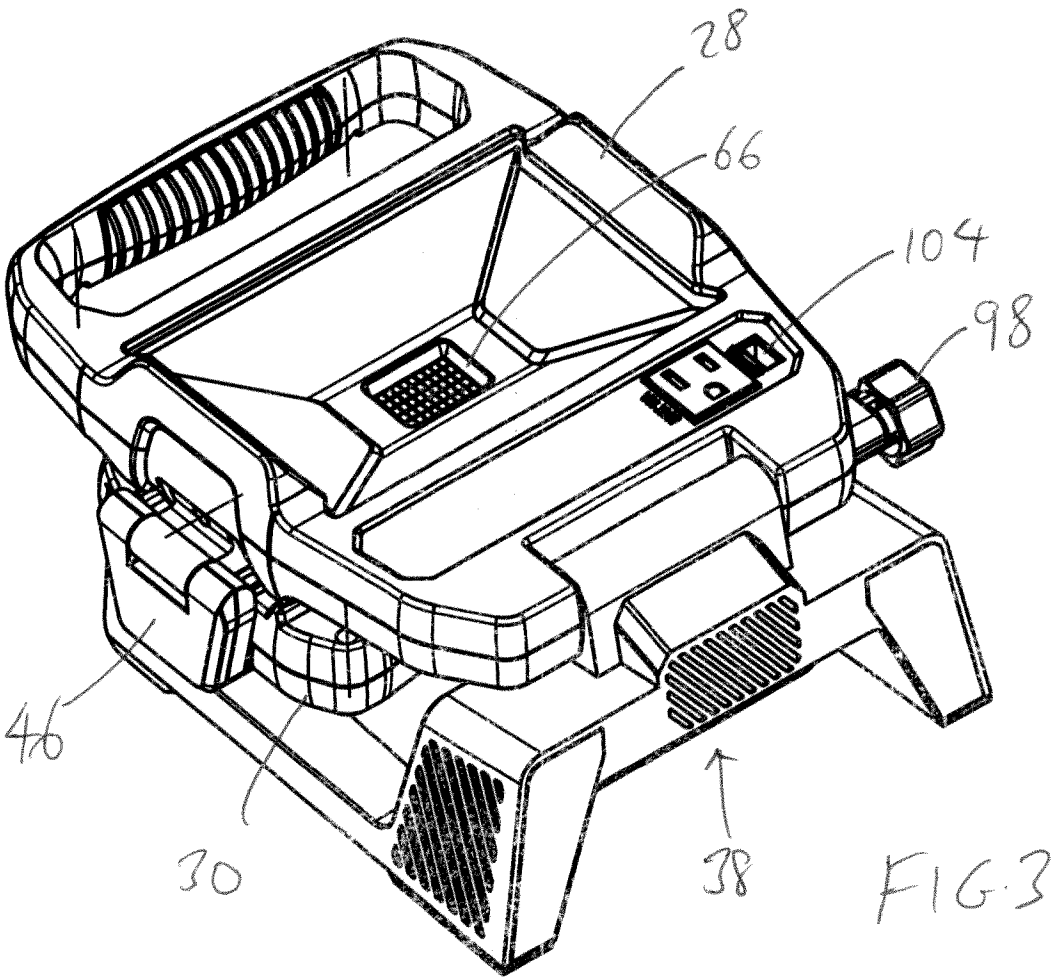
FIG. 3 is a front perspective view of the worklight of FIG. 1 shown in the storage position.
Figure 4:
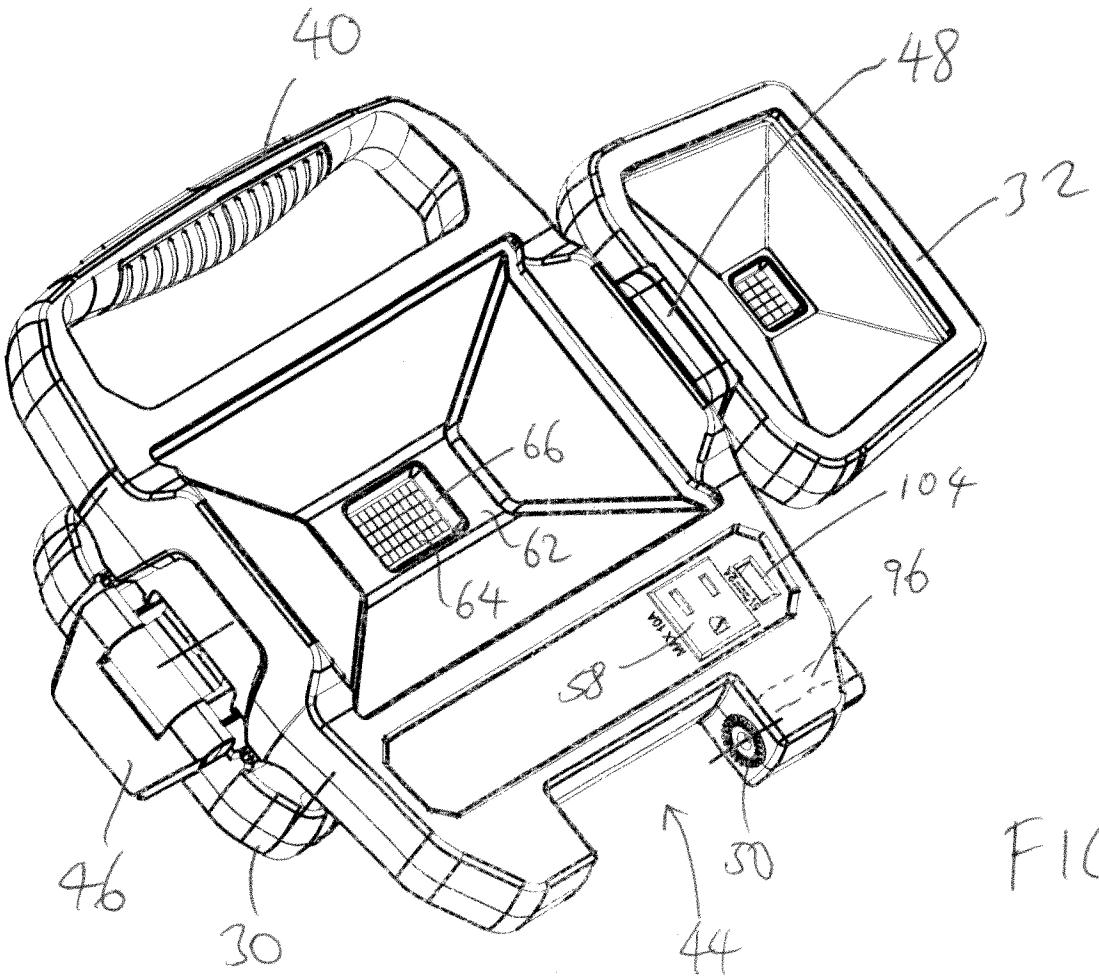
FIG. 4 is a front perspective view of the worklight of FIG. 3 shown without the base, and with one of the side illumination devices opened up.
Figure 5:
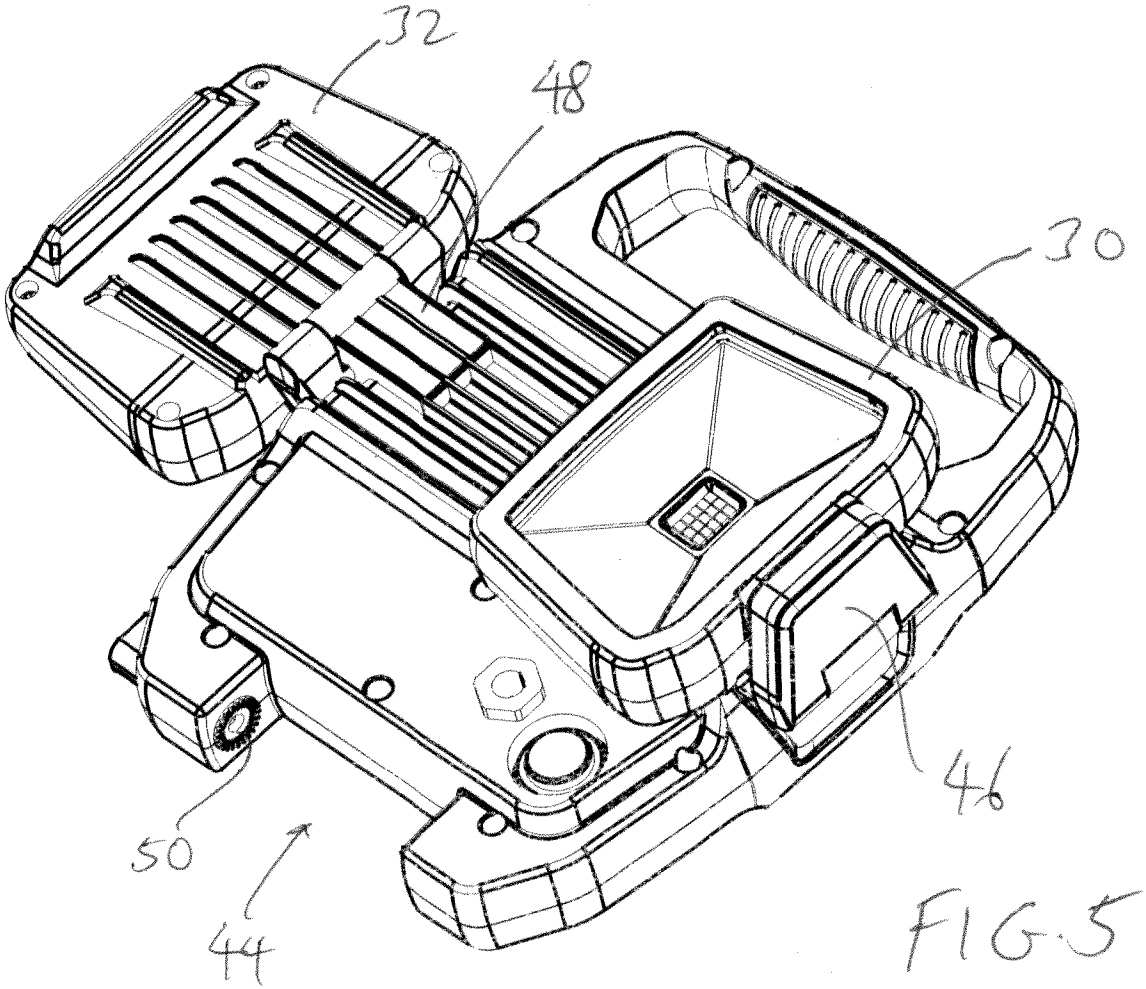
FIG. 5 is a rear perspective view of the worklight of FIG. 4.

Referring also to FIGS. 3-5, each of the left side 34 and the right side 36 is pivotably connected to an arm 46 and 48 from the left side body 30 and the right side body 32, respectively. Each arm 46 and 48 is also pivotably connected to both the respective side body 30 and 32. As a result, each arm 46 and 48 can be pivoted in a controlled manner to allow the left side body 30 and the right side body 32, respectively, to be pivoted between the storage position, where the side bodies 30 and 32 are rested against the rear of the main body 28 (see FIG. 3), and the deployed position shown in FIGS. 1 and 2, where the side bodies 30 and 32 are opened.

Each side body 30 and 32 has an arm 46 and 48, respectively, as described above, and a corresponding illumination device 26 and 24, respectively. The illumination devices 22, 24 and 26 can be identical to each other but can be different in size. Each illumination device 22, 24, 26 has a housing 62 that houses a sink or well 66, Illuminating elements 64 are positioned inside. These illuminating elements 64 can be conventional LEDs. The wells 66 can be configured in any manner, and FIGS. 1 and 3-4 show the illuminating elements 64 arranged as an array consisting of X rows and Y columns of illuminating elements 64. The housing 62 also houses s circuitry and other well-known connections and components that are typically used to connect the illuminating elements 64 to a power supply.

A cut-out region 44 is provided at the lower end of the main body 28. A toothed wheel 50 is provided on opposing ends of the cut-out region 44, and the toothed wheels 50 are adapted to engage corresponding toothed wheels 70 (see FIG. 6) that are provided at opposite ends of a connecting member 72 of the base 38.

Figure 6:
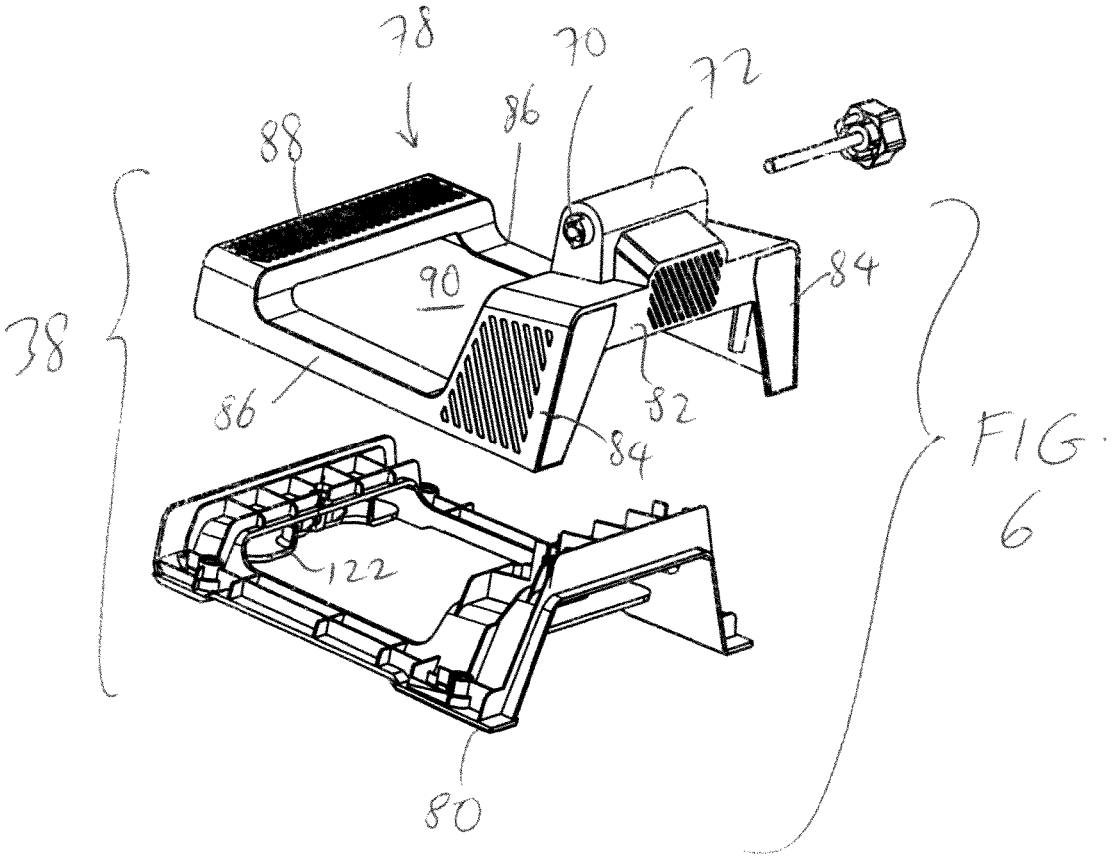
FIG. 6 is an exploded perspective view of the base of the worklight of FIG. 1.
Figure 7:
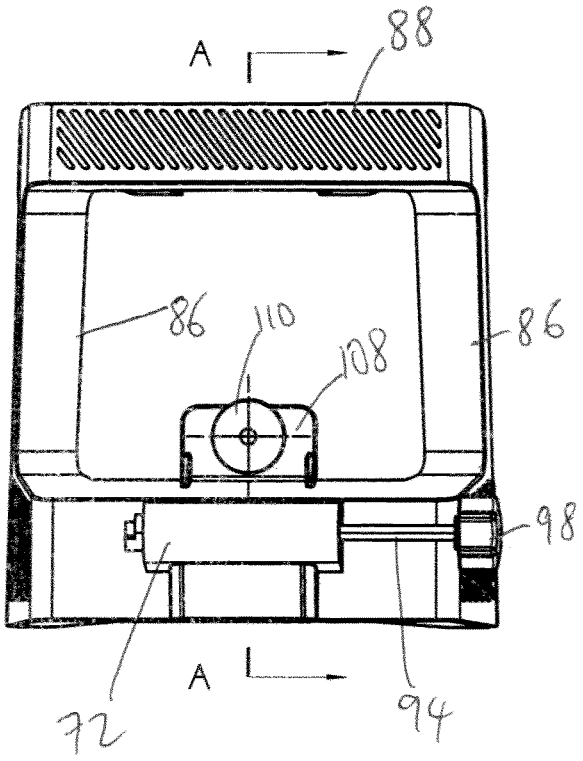
FIG. 7 is a front view of the base of FIG. 6.
Figure 8:
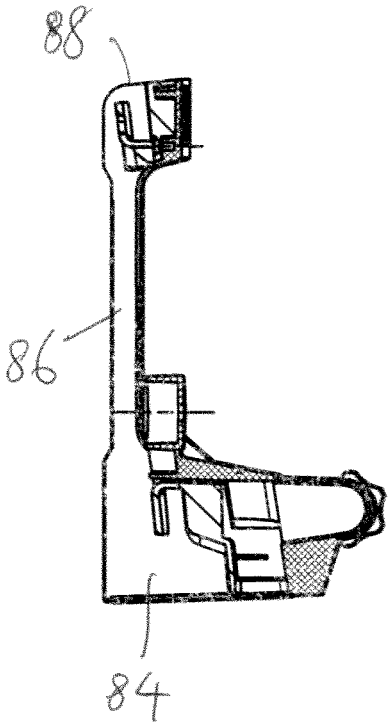
FIG. 8 is a cross-sectional view of the base of FIG. 7 taken along line A-A.

Referring to FIGS. 6-8, the base 38 has a front member 78 and a rear plate 80. The front member 78 has a raised central bar 82 with two legs 84 supported on either side thereof. The connecting member 72 extends from the central bar 82, and has a bore (not shown) extending therethrough between the two toothed wheels 70. A support member 86 extends from each leg 84, and the two support members 86 connect to an elevated resting bar 88. A recessed space 90 is therefore defined between the elevated resting bar 88, the raised central bar 72, and the two support members 86. As shown in FIG. 3, the recessed space 90 is adapted to receive the two folded side bodies 30 and 32 when the worklight 20 is in the storage position. A tab 108 extends from central bar 82 into the recessed space 90, and includes a hole 110 that allows for a user to attach the base 38 to a conventional tripod (not shown).

Figure 10:
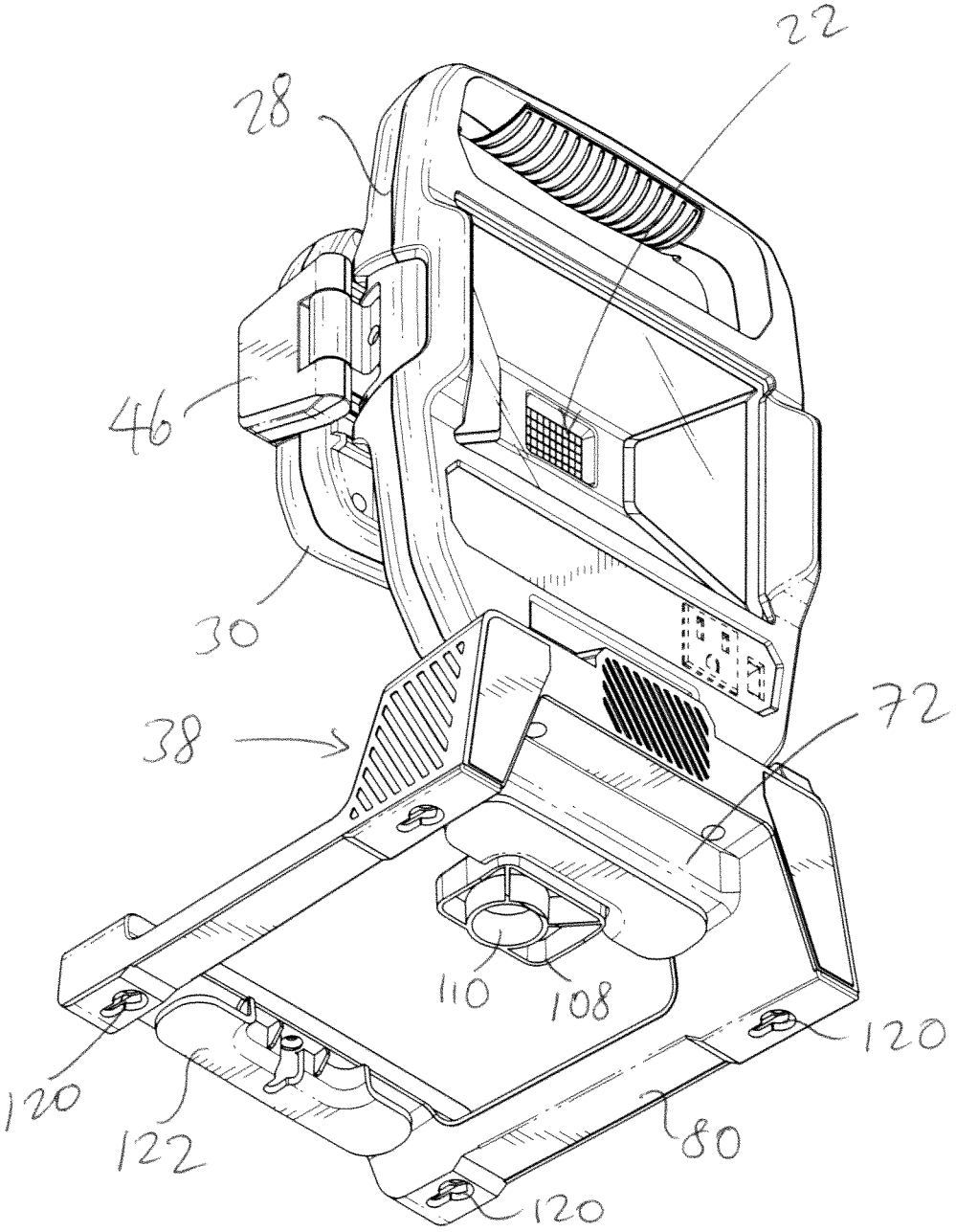
FIG. 10 is a bottom perspective view of the worklight of FIG. 1.

The rear plate 80 has a configuration that corresponds to the front member 76 and provides a rear backing or support to the shaped components of the front member 76. Referring also to FIG. 10, hanging key-shaped slots 120 are provided on the rear of the rear plate 80 and are adapted for receiving hanging bolts (not shown) so that the base 38 can be hung from walls (not shown). Finally, a wire collection bar 122 can be provided along the rear surface of the rear plate 80 to allow the wires (not shown) for the worklight 20 to be wound around it for efficient wire management.

Referring to FIG. 2, the connecting member 72 is fitted into the cut-out region 44 and a shaft 94 is extended through a channel 96 in the lower end of the main body 28, through the toothed wheels 50 and 70, and through the bore of the 1C connecting member 72, exiting the opposite toothed wheel 70 and entering the opposite toothed wheel 50. A thumbscrew 98 is attached to one end of the shaft 94 to allow the user to control the shaft 94. The shaft 94 acts as a pivot for pivoting the main body 28 about the connecting member 72 of the base 38. In this regard, the toothed wheels 50, 70 allow the main body 28 to be automatically locked in a given pivoted position with respect to the base 38 (i.e., the connecting member 72) without the need for another locking device to maintain the main body 28 in that position.

Figure 9:
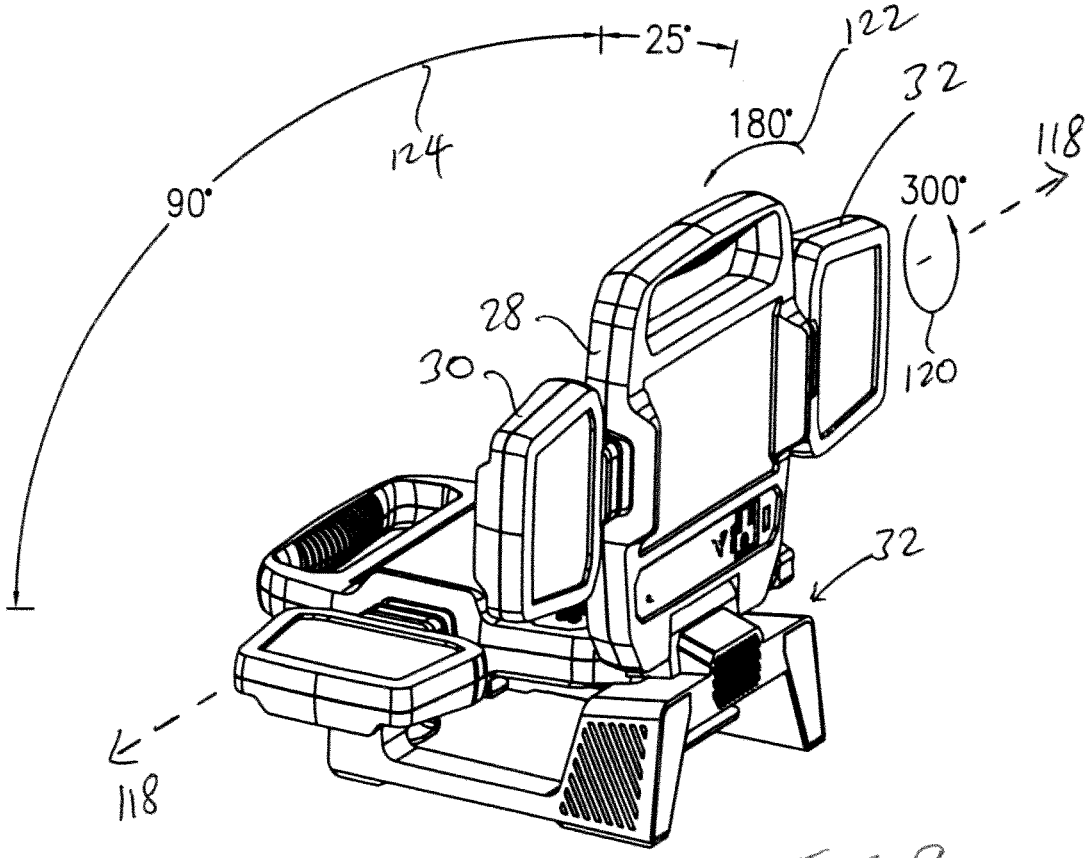
FIG. 9 is a perspective view of the worklight of FIG. 1 showing the various ways in which the side bodies and main body can be pivoted and rotated.

In use, the worklight 20 is deployed in the deployed position shown in FIG. 1, with the side bodies 30, 32 pivoted about the side walls 34, 36, and with the main body 28 pivoted about the base 38. Referring to FIG. 9, the arrow 120 shows that the side bodies 30, 32 can be rotated by up to 300 degrees about an axis 118 that is parallel to the main body 28, and also pivoted (see arrow 122) by up to 180 degrees to be rested against the rear surface of the main body 28 (see FIG. 3). In addition, the arrow 124 shows that the main body 28 can be pivoted rearwardly by up to 90 degrees about the axis defined by the shaft 94 so that the main body 28 can rest on top of the resting bar 88, with the side bodies 30, 32 received inside the receiving space 90. The arrow 124 also shows that the main body 28 can be pivoted forwardly by up to another 25 degrees. FIG. 9 shows the various positions and orientations for the main body 28 and the side bodies 30, 32, and it can be seen that the illumination devices 22, 24, 26 can be quickly and conveniently adjusted and oriented into a 3D variety of different positions to allow the illumination devices 22, 24, 26 to illuminate a workspace of any desired shape or size.

FIG. 3 shows the worklight 20 in its storage position, and it can be seen that the folding of the side bodies 30, 32 against the rear surface of the main body 28, and the subsequent folding of the main body 28 against the base 38, results in a very compact storage configuration for the worklight 20. In addition, it is very easy and fast for a user to fold the side bodies 30, 32 against the rear surface of the main body 28, and to fold the main body 28 against the base 38.

The side bodies 30, 32 and the main body 28, and the base 38, can all be made from the same material, such as plastic or metal or any composite material.

While the description above refers to particular embodiments of the present invention, it will be understood that many modifications may be made without departing from the spirit thereof.

What is claimed is:

1. A portable worklight, comprising:

a main body having a lower end, a left side, a right side, a front surface and a rear surface, with a first illumination device provided on the front surface;

a left side body hingedly coupled to the left side and having a second illumination device;

a right side body hingedly coupled to the right side and having a third illumination device;

a base pivotably mounted to the lower end of the main body and having a connecting member that is pivotably connected to the lower end of the main body;

wherein the worklight can be configured in a deployed position and a storage position, wherein in the storage position, the left side body and the right side body folded against the rear surface of the main body, and the rear surface of the main body is pivoted against the base; and wherein the base has a raised central bar with two legs supported on either side of the central bar, with the connecting member extending from the central bar, the base further including a support member extending from each leg, and with the support members connect to an elevated resting bar, and wherein a recessed space is defined between the elevated resting bar, the raised central bar, and two support members, with the recessed space adapted to receive the left side body and the right side body when the worklight is in the storage position.

2. The worklight of claim 1, wherein the left side body and the right body are pivoted away from the rear surface of the main body when the worklight is in the deployed configuration.

3. The worklight of claim 1, wherein the main body is pivoted away from the base when the worklight is in the deployed configuration.

4. The worklight of claim 1, wherein the first, second and third illumination devices are all comprised of an array of LEDs.

5. The worklight of claim 1, wherein the connecting member has a shaft extending therethrough to pivotably connect the connecting member to the lower end of the main body.

6. The worklight of claim 1, wherein the main body rests against the elevated resting bar when the worklight is in the storage position.

7. The worklight of claim 1, further including a connecting tab that is connected to the base and which extends inside the recessed space.

8. The worklight of claim 1, wherein the base has a rear plate, and at least one mounting slot provided in the rear plate.

* * * * *